United States Patent [19]

Fegley

[11] 3,972,447

[45] Aug. 3, 1976

[54] FLUID DISPENSING ANTI-BURGLAR DEVICE

[76] Inventor: Charles Robert Fegley, 1606 Frush Valley Road, Laureldale, Pa. 19605

[22] Filed: Jan. 2, 1976

[21] Appl. No.: 645,950

[52] U.S. Cl. ..... 222/5; 222/402.14; 222/402.15; 222/509; 239/274

[51] Int. Cl.[2] ..... B67B 7/24

[58] Field of Search ..... 222/402.14, 402.15, 222/509, 5, 180, 182, 183; 239/274

[56] References Cited

UNITED STATES PATENTS

| | | | |
|---|---|---|---|
| 3,032,788 | 5/1962 | Lowther, Jr. | 222/5 X |
| 3,549,054 | 12/1970 | Ettery | 222/509 X |
| 3,806,000 | 4/1974 | Fegley | 222/402.14 X |

*Primary Examiner*—Allen N. Knowles

[57] ABSTRACT

A fluid dispensing anti-burglar device is disclosed in which a chemical irritant such as tear gas is discharged into the area to be protected when an intruder forces entry into an area with which the device is associated. The anti-burglar device employs an element to delay the release of the chemical irritant. It also has provisions for resetting the trigger and recocking the spring associated with the device if the device is accidentally triggered.

23 Claims, 27 Drawing Figures

FLUID DISPENSING ANTI-BURGLAR DEVICE

BACKGROUND OF THE INVENTION

The invention relates generally to an anti-burglary device and more particularly to an anti-burglary device which discharges a chemical irritant such as tear gas from a pressurized container, one type of which is an aerosol container, into a protected area upon actuation by an unauthorized person, causing the protected area to be flooded with the chemical irritant and thereby forcing evacuation of the protected area by the intruder.

Chemical weapons have been known in the art for many years. One type of chemcial weapon is the conventional tear gas grenade which is generally triggered manually and the grenade is manually hurled at a target area, causing the target area to be flooded with the chemical irritant.

In another type of chemical weapon, the chemical irritant is stored under pressure in an aerosol type container. The actuating member is again generally triggered manually and the chemical irritant in the form of a spray is manually directed at the target.

A third type of chemical anti-burglar device discharges an explosive tear gas shell into the area but this type is both dangerous and very limited as to the amount of tear gas which is discharged into the area to be protected.

A fourth type of chemical anti-burglary device is of the booby trap type in which a pressurized container releases its contents into an area to be protected. This type of device, when accidentally tripped by a person authorized to be in the protected area, cannot be deactivated and discharges its contents into the area forcing the authorized personnel to leave the protected area.

Thus what is needed is an anti-burglar device in the form of a chemical irritant dispenser which can be discharged by a relatively small amount of force even though the device employs a relatively heavy spring for causing the dispensing of fluid. A time delay element to provide a small time delay, after the device is triggered, to permit an authorized person who accidentally triggers the device to reset it before the device discharges fluid.

SUMMARY OF THE INVENTION

The principle object of the present invention is to provide an anti-burglary device of the fluid dispensing type which will provide a time delay between the actuation of its trigger and the release of the fluid. This time delay permits the anti-burglary device to be recocked by authorized personnel if the device is accidentally triggered; yet the time delay is not long enough to permit an intruder to deactivate it.

A further object of the invention is to provide an anti-burglar device of the chemical weapon type which is readily triggered by opening a door or window by an intruder entering an unauthorized area or by moving an object with which the device is connected.

Another object of the invention is to provide an improved means of dispensing fluid into a protected area in a minimum amount of time in order to force an intruder from the protected area and to prevent the intruder from re-entering the area for a reasonable amount of time.

A further object of the invention is to provide an anti-burglary device having means for reloading the device and resetting the trigger after the device has been discharged.

Another object of the present invention is to provide a directable discharge of the fluid, such as by means of a rotatably adjustable dispensing head, so that the device can be located on a door, wall, or the like, and yet, when the device is actuated, the fluid is directed into the area to be protected.

According to the principle aspect of the present invention there is provided an improved means for releasably retaining spring biased elements in a cocked position. Such means includes a trigger adapted to be movably mounted between an actuation position and a release position. The trigger is associated with a door, window or an object which might be moved by an intruder entering a room or building or other area from which it is desired to restrict unauthorized persons. When the trigger is in its actuation position, it retains the spring biased elements in their cocked position. When the intruder trips the device, the trigger moves from engagement with the spring biased elements to a release position, thereby permitting the spring biased element to be moved to dispense fluid from the pressurized container. Before fluid is discharged, however, a time delay of a few seconds is caused by the time delay element. The time delay element is shown for convenience as being comprised of the pnuematic type.

The anti-burglary device of the present invention may be utilized in homes, factories, farms or office buildings and may also be used in connection with vehicles such as boats, trucks, airplanes, etc. The device may also be employed for any other application wherein it is desired to prevent unauthorized persons from moving certain objects by placing the mounted device against the object.

Once actuated and after the time delay, the device will dispense the entire amount of fluid in the pressurized container into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 3:
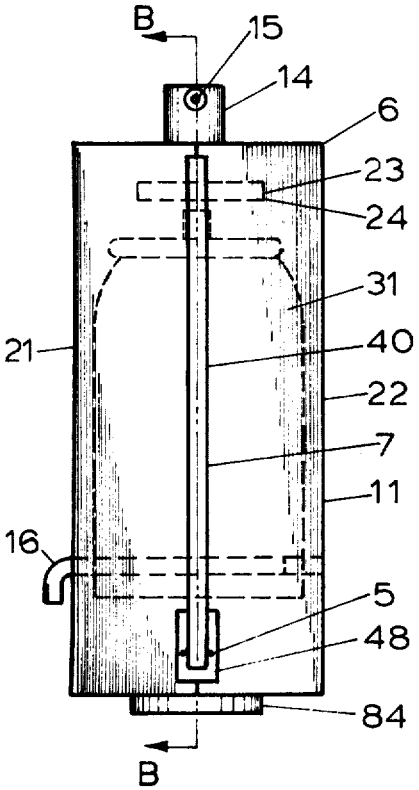
FIG. 3 is a front elevational view of the fluid dispensing anti-burglar device.

Referring now to the drawings in detail, wherein like reference characters designate like parts throughout the various views, there is shown in FIGS. 1–6, one form of the fluid dispensing anti-burglar device, called device hereafter, of the chemical weapon type according to the present invention, generally designated 6. The device 6 is secured to a wall 2 and connected by means of a cord 5 to a window sash 3 in the wall 2 so that upon opening of the window sash 3 by a burglar or intruder, the device 6 will be actuated to discharge a fluid 13 such as tear gas into the restricted area. The device 6 whose front is shown in FIG. 3 comprises of a pressurized container 31, called pressurized container hereafter, mounted in a body member 11 shown as being comprised of a left body half 21 and a right body half 22. The body halves 21 and 22 when assembled provide three flat sides, other than the front, for mounting the device 6 to the wall 2 adjacent to the window frame 1 or elsewhere, as may be convenient, and the cord 5 connected from the device 6 to a wide variety of objects in many ways.

Figure 6:
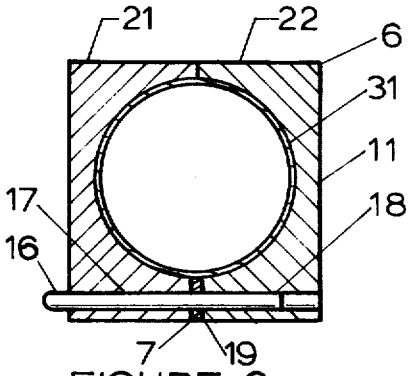
FIG. 6 is a vertical section taken along line A—A of FIG. 3 with the trigger locked by a safety pin.
Figure 5:
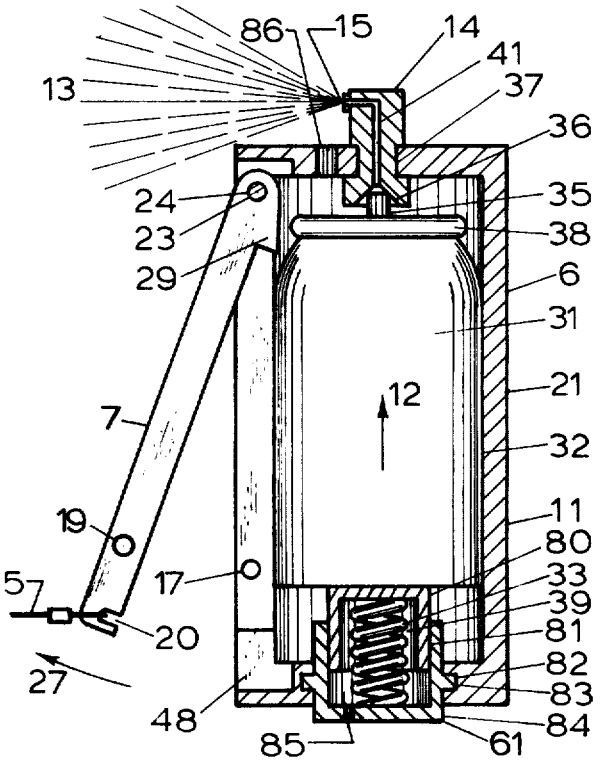
FIG. 5 is a horizontal section taken along line B—B of FIG. 3 similar to FIG. 4 but shows the device dispensing fluid.
Figure 4:
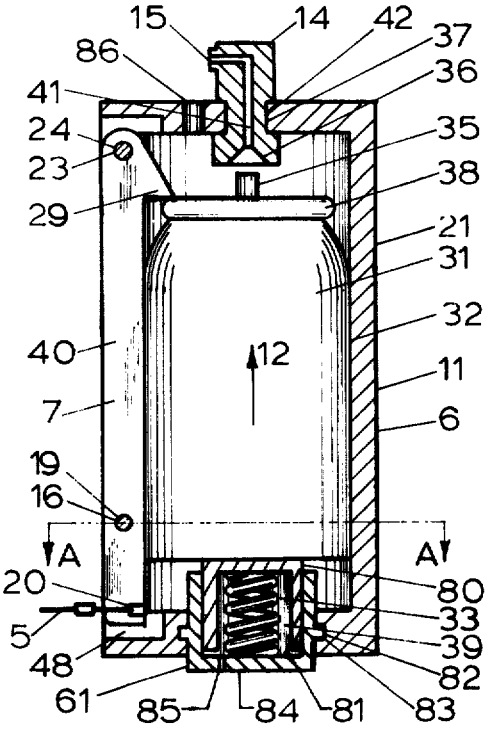
FIG. 4 is a horizontal section taken along line B—B of FIG. 3 showing the spring biased elements in a cocked position and the dispensing element displaced from its actuation means.

The coaxial cylindrical bores 32, 37 and 83, as shown in FIGS. 4 and 5, are formed when the symmetrically opposite body halves 21 and 22 are joined together as shown in FIGS. 3 and 6. The cylindrical bore generally designated 32 slidably mounts the pressurized container 31. The pressurized container 31 of which one type is sold by Defense Products Manufacturing Corporation, 1628 South Hanley Road, St. Louis, Mo. identified as their "Paralyzer" and another type is sold by Penquin Industries, Inc., Parkesburg, Pa. identified as their "10-4 10-4 Chemical Billy" but the invention is not limited to the use of these containers. The pressurized container 31 includes a fluid dispensing element which comprises of a spring urged projecting dispensing spout 35 which when depressed discharges a fluid 13 through the center of the projecting dispensing spout 35.

Figure 19:
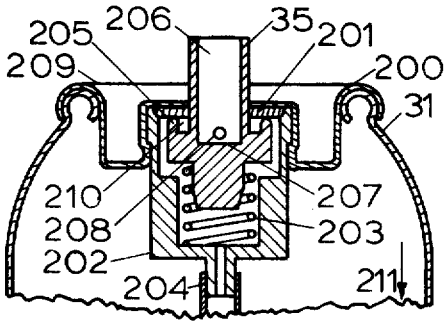
FIG. 19 is a partial vertical section showing a valve for use with the pressurized container having a projecting dispensing spout.

One type of pressurized container 31, shown as having a fluid-dispensing element in the form of a projecting dispensing spout 35, for use in this embodiment is shown in FIG. 19 as containing a valve assembly generally designated 200. Valve assemblies of this type are well known in the trade and one type of which is sold by Scovill, Manchester, N.H. as their S-63 valve assembly. The valve assembly 200 is shown as being comprised of a projecting dispensing spout 35 which has generally a hollow tube portion 206 and is closed at one end 207 thereof. A valve seat 205 is formed around the sealed end 207 of the dispensing spout 35 and contains a recessed portion 210 formed to provide a fluid passageway which will permit fluid flow to a discharge hole 208 and gives fluid access to the hollow tube 206. The dispensing spout 35 is slidably mounted in spring cup 202 and is urged by spring 203 toward the valve seal 201. In this position, the valve seat 205 forms a fluid seal with the valve seal 201. A dip tube 204 may be attached to the spring cup 202 to provide access to fluid when in liquid form in the bottom of the pressurized container. The assembly is generally mounted in a metal cup 209 which is then fastened to the pressurized container 31.

When the projecting dispensing spout 35 is moved in direction 211, the valve seat 205 is separated from the valve seal 201 thereby, permitting fluid under pressure to flow up dip tube 204, around the valve seat 205, through the discharge hole 208 and out the hollow tube 206.

Now referring to FIGS. 4 and 5; the cylindrical bore generally designated 83 is coaxial with the cylindrical bore 32 and provides a means for confining a time delay assembly 84. The time delay assembly 84 is used to provide a timed delay from the time the trigger 7 is released until fluid is discharged. This timed delay permits the resetting of device 6, which will be described later, if accidentally released.

One type of time delay assembly that may be used with this device is shown as being comprised of a cylindrical cup 80 slidably fit into a second cylindrical cup 61 wherein the cups 61 and 80 will slide freely relative to each other but will provide an air seal between each other. A very small hole 85 is positioned in the cylindrical cup 61 to permit a small flow of air to enter the cavity 39, formed by the assembly of the cylindrical cups 61 and 80, when the cylindrical cups are moved relative to each other. By changing the diameter of hole 85, the time of the delay will be changed; the smaller the diameter hole, the longer the timed delay. A spring 33 is mounted in the cavity 39 formed by the cylindrical cups 61 and 80 such that the spring urges the separation of the cylindrical cups 61 and 80. The time delay assembly 84 is mounted in device 6 to urge the pressurized container 31 in the direction 12. It should be noted that the cylindrical cup 80 could also be considered as piston 80.

Again referring to FIGS. 4 and 5, the body member 11 forms a cylindrical bore 37 and provides means for mounting a rotatable dispensing head 14. The dispensing head 14 contains a fluid passageway 41 having an entry section 36 at one end thereof for engaging with the projecting dispensing spout 35 of container 31 and a discharge section 15 on the other end. The dispensing head 14 provides a means for the fluid 13 to be discharged into and directed from when the projecting dispensing spout 35 of the container 31 is forced into the entry section 36 by the spring 33 acting to move the slidably mounted container 31 in the direction of arrow 12. The funnel shape of the entry section 36 engages the projecting dispensing spout 35, which is made of a relatively soft material and therefore provides an adequate seal at the entry section 36 to retain fluid flow in the passageway 41 at pressures normally used in the pressurized container 31.

The container 31 in the position illustrated in FIG. 4 is in its cocked position where the spring 33 is compressed and the spout 35 is coaxial but displaced from the entry section 36. The container 31 is releasably restrained in a cocked position by a trigger 7. The trigger 7 is generally a flat member and includes a shaped latch portion 29, holes 24 and 19 and a notch 20 and is best seen in FIGS. 4 and 5. The trigger is rotatably mounted on a pivot pin 23 and is slidably contained in slot 40 formed by the body halves 21 and 22. The shaped latch portion 29 engages the rim 38 of the container 31 when in the cocked position as shown in FIG. 4. The spring 33 urged container 31 causes trigger 7 to rotate counterclockwise as shown in FIG. 4 around pivot pin 23 and therefore will be held against the interior surface of slot 40 formed by body halves 21 and 22, thus retaining the container 31 in its cocked position.

The container 31 may be locked in its cocked position and the trigger 7 in its set position as shown in FIG. 6 by means of a safety pin 16 which passes through hole 17 in body half 21, next through hole 19 in trigger 7 and hence through hole 18 in body half 22. Holes 17, 18, 19 are coaxial on assembly and cocking of trigger 7 and are perpendicular to the plane of travel of the trigger 7 such that when safety pin 16 is inserted through holes 17, 18 and 19 the trigger 7 is restrained from moving, thereby, safely retaining the container 31 in its cocked position.

A notch, 20, is provided near the end of the trigger 7. The looped cord 5 is connected at one end to the window sash 3 and at its other end to the trigger 7 by being looped over the trigger 7 to engage notch 20. When it is desired to place the device in condition for firing upon opening of the window sash 3, the safety pin 16 is removed from holes 17, 18 and 19. If the window sash is opened by a burglar or other intruder, the cord 5 will be pulled in such a manner as to rotate the trigger 7, thereby moving the shaped latch portion 29 out of engagement from the rim 38 of the container 31 permitting the container 31 to be moved in direction 12. The spring 33 urges the cylindrical cup 80 in direction 12 and thereby also moves the cylinder 31. As the cylindrical cup 80 is separated from cylindrical cup 61, a vacuum is formed in spring cavity 39, thereby preventing further movement of cylindrical cup 80. A small hole 85 in cylindrical cup 61 permits a small flow of air into the spring cavity 39 and permits the spring 33 to slowly move the cylindrical cup 80 and the cylinder 31 toward the funnel shaped entry section 36. After a time delay, the fluid-dispensing element in the form of a projecting spout 35 engages with the dispensing element-actuating means in the form of a funnel shaped entry section 36 of the fluid passageway 41 and thereby causes fluid discharge as the projecting dispensing spout 35 is depressed.

After the device has been discharged in the manner described herein above, the body halves can be separated to replace the container 31, after restoring trigger 7 to its cocked position as depicted in FIG. 4.

Figure 7:
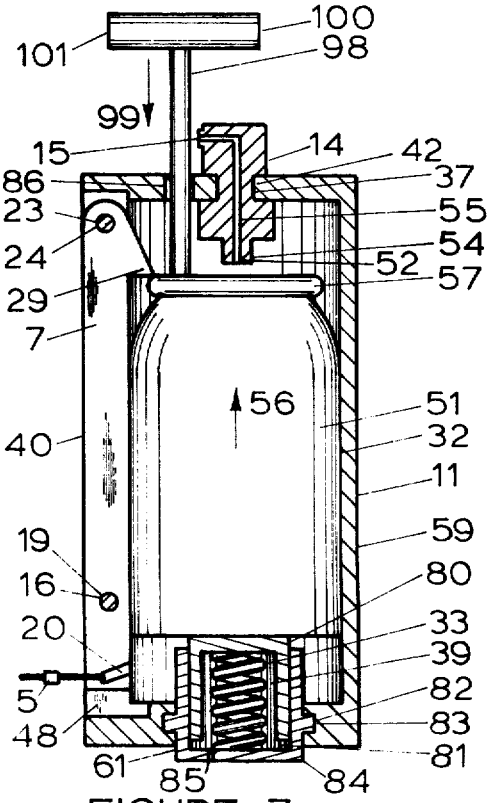
FIG. 7 is a horizontal section similar to FIG. 4 but showing a second embodiment of the anti-burglar device containing a pressurized container of the aerosol type but having a recessed valve.

If the device 6 is accidentally triggered, the trigger 7 may be reset and the spring recocked as shown in FIG. 7, by inserting a tool generally designated 100. The tool 100 is comprised of a handle 101 and a shaft like extension 98. The extension 98 is inserted into hole 86 of device 6 to engage with and move container 31 in direction 99 so that the latch portion 29 of trigger 7 may be moved into engagement with the rim 38 of the container; thereby resetting the device.

It is an important feature that the trigger 7 be rotatable and that the shaped latch portion 29 thereof present a surface which will slide smoothly on the rim 38 of the container 31 when the trigger 7 is pulled. As a consequence the trigger 7 may be easily withdrawn from engagement without substantial force. Yet when the trigger 7 is positioned in engagement with the rim 38 of the container 31, the trigger 7 serves to positively retain container 31 in its cocked position. Hence substantially less force is required to trigger device 6 of the present invention than would be required if the container 31 were retained in its cocked position by means of a transversely extending trigger pin or the like, yet the container 31 is still safely retained in its locked position against accidental release by safety pin 16 passing through holes 17, 18 and 19.

Yet another important feature is that the dispensing head 14 is rotatable in socket hole 37 through a large angle up to 360° so that the fluid 13 may be directed into any area relative to the triggering object.

Another important feature is that the spring 33 be of substantial force so that the projecting dispensing spout 35 will seat in the entry section 36 with sufficient force to release the pressurized fluid through the passageway 41 and out the dispensing head 14.

Figure 1:
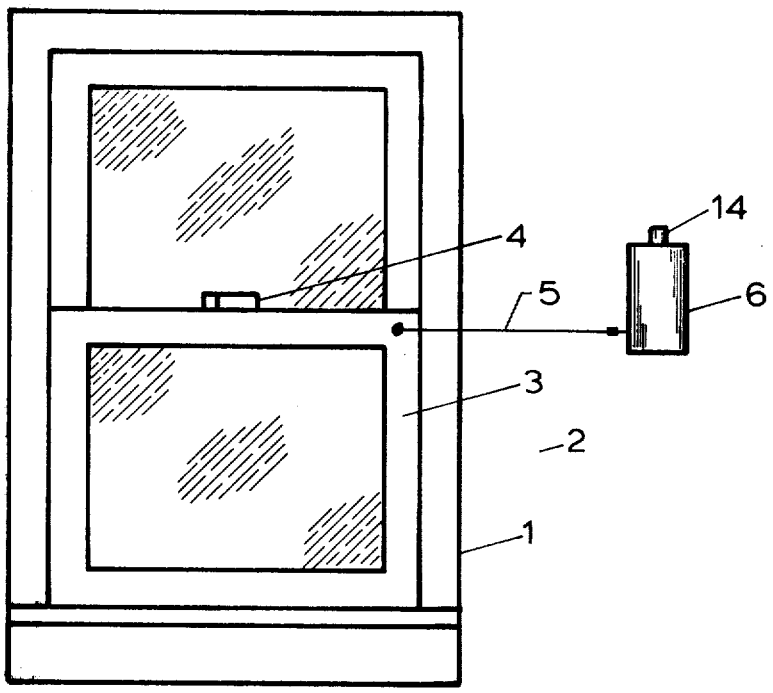
FIG. 1 is an elevational view of a wall of a room having one embodiment of the fluid dispensing anti-burglar device secured to the wall and connected by means of a cord to the sash of a window in the wall.
Figure 2:
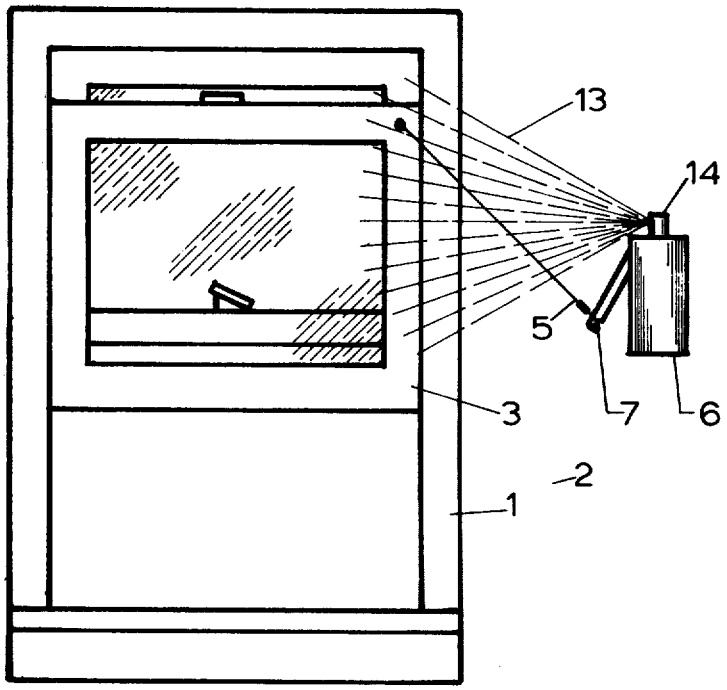
FIG. 2 is an elevational view similar to FIG. 1, but showing the window open and the device dispensing fluid.

If it is desired to utilize the fluid dispensing anti-burglar device again, it is reset as illustrated in FIG. 1. If it is desired to render it temporarily inoperative, the safety pin 16 is inserted through the passages 17, 18 and 19 to lock the trigger 7 and thence the container 31 in its cocked position.

Another important feature is that the slot 48 in body halves 21 and 22 for inserting the looped cord 5 be made with a minimum clearance for the looped portion of the cord 5. It is also important to keep the opening of the loop of cord 5 just wide enough to slip over the end of trigger 7. By keeping the loop and the slot 48 in body halves 21 and 22 as narrow as possible; it becomes very difficult, if not impossible, to move the trigger 7 without a specially shaped loop or hook placed in slot 20 of trigger 7. This is necessary to keep small children from accidentally triggering the device.

Further security from accidental release is achieved by keeping the trigger 7 flush with or recessed from the exterior surface of the body halves 21 and 22. By mounting the trigger 7 in the body halves 21 and 22 in this manner, there is no surface of the trigger 7 exposed to grip and therefore cannot be released.

It is also important in this embodiment that the fluid-dispensing element comprises of a dispensing valve 200 having a projecting dispensing spout 35 which when depressed causes fluid discharge therethrough. The fluid passageway 41 contains the fluid dispensing-actuating means in the form of a funnel shaped entry section 36 which engages the projecting dispensing spout 35 and forms a seal between the entry section 36 of passageway 41 and the projecting dispensing spout 35.

Although the device 6 is shown as having the fluid passageway 41 contained in a rotatable dispensing head; the passageway may also be formed in the body member 11.

A second embodiment of the invention is illustrated in FIG. 7. In this embodiment the basic structure is as previously described and like numbers are used to indicate like or corresponding parts.

In this embodiment, the pressurized fluid container 31, shown in FIG. 4 having a projecting dispensing spout 35, is replaced with a pressurized fluid container 51, shown in FIG. 7, having a recessed value. Pressurized containers of the aerosol type with a recessed dispensing valve are well known in the trade. In addition, the funnel shape of the entry section 36 of the fluid passageway 41 of the first embodiment shown in FIG. 4 is replaced with projecting spout 54 depending from dispensing head 14, all of which are shown in FIG. 7.

In this embodiment, all elements function as described in the first embodiment with the following difference. The pressurized container 51 is discharged by the action of the time delay assembly 84 moving the pressurized container 51 such that the recessed valve of the pressurized container 51 is depressed through engagement with projecting spout 54 and thereby effects discharge.

Figure 20:
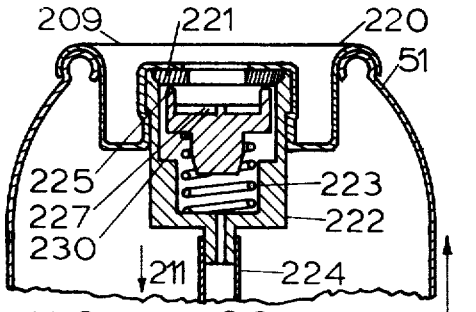
FIG. 20 is a partial vertical section showing a valve for use with a pressurized container having a recessed valve.

One type of recessed valve for use in this embodiment is shown in FIG. 20 and is generally designated 220. Valve assemblies of this type are well known in the trade and one type of which is sold by Scovill, Manchester, N.H. The valve assembly 220 is shown as being comprised of a valve seat 225 mounted in a spring cup 222. The valve seat 225 contains a recessed portion 230 and recessed channels 227 formed in valve seat 225.

The valve seat 225 is slidably mounted in spring cup 222 and is urged by spring 223 toward valve seal 221. In this position, the valve seat 225 forms a fluid seal with the valve seal 221. The valve assembly 220 is generally mounted in a metal cup 209 which is then fastened to the pressurized container 51.

When the device 6 is triggered, the valve assembly 220 is moved along with the pressurized container 51 in the direction 56. As movement continues, the projecting spout 54 of the dispensing head 14 engages with and moves the valve seat 225 from engagement with valve seal 221 permitting fluid under pressure to flow around the valve seat 225, through the discharge channels 227 and out passageway 55. When the projecting spout 54 entered the valve assembly 220, the valve seal 221, being made of resilient material, formed a seal between the circumference of the projecting spout 54 and the valve seat 221, thus preventing fluid leakage.

The fluid 13 is then discharged through the valve 220 of the pressurized container 51, through the entry section 52 and passageway 55 and out the dispensing head 14, then into the area to be protected.

As shown in FIG. 7, when the cord 5 is pulled and the safety pin 16 removed, the trigger 7 is rotated. This causes the shaped latch portion 29 to be moved from container rim 57 and permits the container 51 to be moved in direction 56, causing discharge through the action of the projection dispensing spout 54 acting on the recessed valve 220 of container 51. The fluid will then be forced up through passageway 55 and disperced through orifice 15.

It is important in this embodiment that the fluid-dispensing element comprises of a recessed valve assembly 220 which when depressed causes fluid discharge. It is also important that the entry section 52 of passageway 55 contain a fluid dispensing element — actuating means in the form of a projecting spout 54 which engages with the recessed valve assembly 220 and causes fluid discharge.

Figure 8:
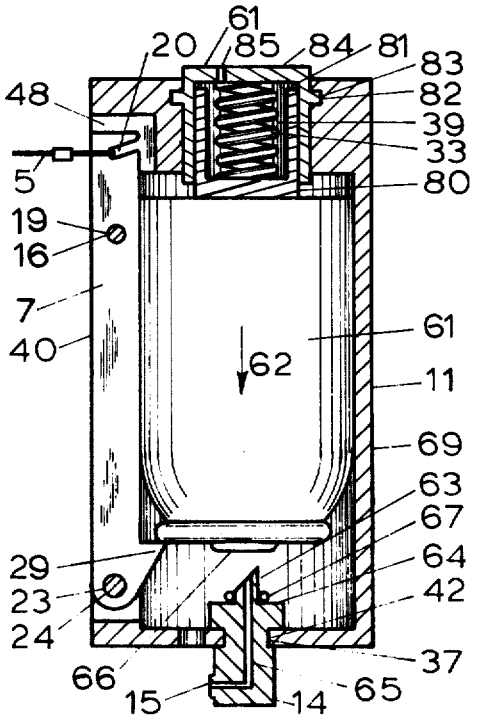
FIG. 8 is a horizontal section similar to FIG. 4 but showing a third embodiment of the anti-burglar device containing a pressurized container of the type with a pierceable seal and a means for piercing the seal.

A third embodiment of the invention is illustrated in FIG. 8. In this embodiment the structure is as previously described in the first embodiment and like numbers are used to indicate like or corresponding parts.

In this embodiment, the pressurized fluid container 31, shown in FIG. 4 of the first embodiment and having a projecting dispensing spout 35, is replaced with a pressurized fluid container 61 shown in FIG. 8, having a pierceable seal 66. Pressurized containers having pierceable seals are well known in the trade. In addition, the funnel shaped entry section 36 of the body halves 21 and 22 of the first embodiment shown in FIG. 4 is replaced with body halves 68 and 69 having a projecting section 63 shaped to pierce seal 66 and a means of making a fluid seal capable of withstanding the pressure required for effectively discharging fluid through the passageway 65 and into the restricted area.

Now referring to FIG. 8, FIG. 8 is an inverted embodiment of FIG. 4 of the first embodiment in which all elements function as described in the first embodiment with the following exceptions. The pressurized cylinder 61, when released by the trigger 7, is forced by spring 33, after a timed delay, into pierceable engagement with the piercing projecting section 63. As the pierceable seal 66 is pierced by the action of the projection forward section 63, the spring 33 continues to move the container 61, forming a seal by the action of the O-Ring 67 and its retaining seat 64 and the pierceable seal 66 of the pressurized container 61. The fluid 13 is then discharged through the pierced seal 66 of the pressurized container 61, through passageway 65, out the orifice 15, and then into the area to be protected.

It is important in this embodiment that the fluid-dispensing element comprises a pierceable seal 66 which when pierced will permit fluid discharge therethrough. It is also important that the dispensing element-actuating means comprise of a projecting piercing section 63 set in a position to pierce the pierceable seal 66 when the pressurized container 61 is moved toward it. It is also important that a seal be made around the projecting piercing section 63 to prevent fluid leakage within the body member 11 after the pierceable seal is pierced.

Figure 9:
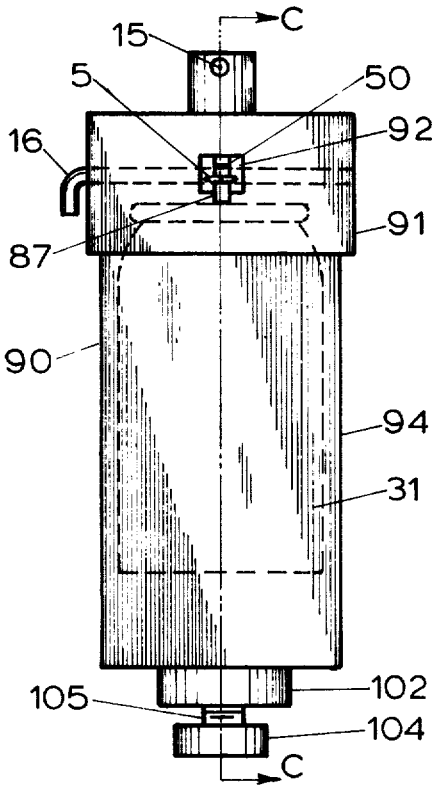
FIG. 9 is a front elevational view of the fluid dispensing anti-burglar device but showing a fourth embodiment containing a slidably mounted trigger.
Figure 10:
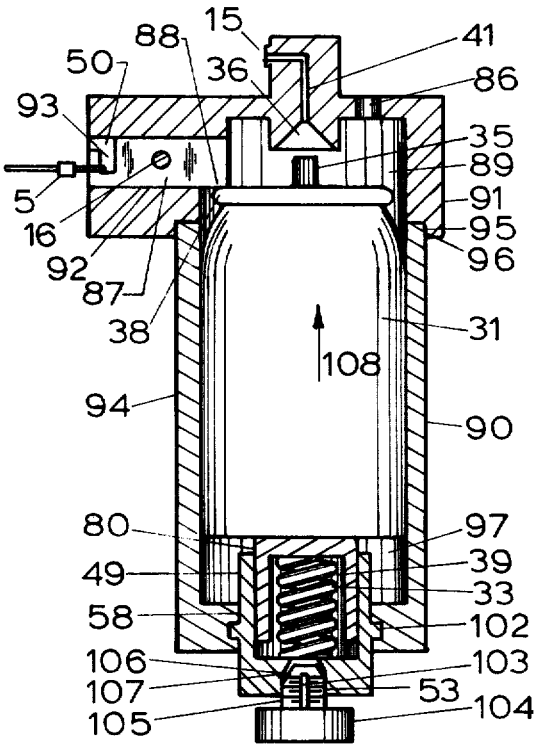
FIG. 10 is a horizontal section taken along line C—C of FIG. 9 showing the spring biased elements in a cocked position and held in a cocked position by a slidably mounted trigger.

The preceeding embodiments of the invention show the fluid dispensing anti-burglary device in its preferred embodiments containing a rotatable trigger 7 but it is recognized that the trigger 7 may be slidably mounted as shown in FIGS. 9 and 10. In addition, the body member may be constructed in a different manner as shown in FIGS. 9 and 10.

Therefore, a fourth embodiment of the invention is illustrated in FIGS. 9 and 10. In this embodiment, the basic structure is as previously described in the first embodiment and like numbers are used to indicate like or similar parts.

In this embodiment, as shown in FIGS. 9 and 10, the body member 94 is constructed of a lower body section 90 and an upper body section 91. The exterior of lower body section 90 is round in shape while the interior comprises of two coaxial cylindrical bores 97 and 58. The cylindrical bore 97 slideably supports the pressurized container 31 and the cylindrical bore 58 serves to mount the time delay assembly 102.

The upper body section 91 is rectangular in shape and contains a round bore 95 sized to receive the upper most portion 96 of the lower body section 90 as shown in FIG. 10. Adhesives may be used to fasten the two body sections 90 and 91 after assembly.

A slot 50 is formed in the upper body section 91 to slidably mount a flat trigger 87. It is important that the catch 88 on the trigger 87 slide freely on the flange 38 of pressurized container 31 and also in the slot 50.

A cylindrical bore 89 must also be formed in the upper body section 90 to provide clearance for the pressurized container 31. A fluid passageway 41 and a funnel shaped entry section 36 must also be formed in upper body section 90 which is coaxial with but displaced from the dispensing spout 35 of container 31.

A wide slot 92 is provided where the cord 5 is slipped over the slot 93 in the trigger 87. It is important that this slot be no wider than required for the clearance of the cord 5 to prevent someone from accidentally triggering the device when the cord is removed.

An additional safety is provided by a safety pin 16 which operates in a manner previously described.

When it is desired to activate this device, the cord 5 is connected in slot 93 of trigger 87 and the safety pin 16 is removed as previously described. An intruder causing the cord 5 to be pulled will slide the trigger 87 from engagement with the container 31. Thus permitting the spring 33 to move the container 31 through its timed delay assembly 102 in a manner to cause the dispensing spout 35 to move into engagement with the entry section 36 of the fluid passageway 41 and cause discharge in a manner previously described.

This type of trigger does not have the mechanical advantage of the rotatable trigger and requires more force to release the container but can be effectively used for many applications.

As shown in FIGS. 9 and 10, the time delay assembly 102 in this embodiment contains a means to adjust the time delay between the release of trigger 87 and the discharge of fluid. The time delay assembly works as previously described except that the air input hole 85 has been replaced with a means to vary the air flow into the spring cavity 39 and thereby control the timed movement of cylindrical cup 80. The cylindrical cup 49 contains a tapered portion 106 and threaded hole 53. A knob 104 containing a threaded portion 105 and a tapered section 107 is screwed into the threaded hole 53. It is important that the taper 107 of the knob 104 and the taper 106 of the cylindrical cup 49 be of the same angle. By turning the knob 104 until its taper 107 is seated against the taper 106 of the cylindrical cup 49, no air will flow into the spring cavity 39 and cylindrical cup 80 will not move. As the taper 106 and 107 are separated, the flow of air into cavity 39 is increased and the time delay is decreased. An air vent 103 is cut into the threaded portion 105 of knob 104 to provide easy passage of air to the tapered portions.

It should also be noted that the fit between the cylindrical cup 80 and cylindrical cup 49 can be used to control the air flow into the spring cavity 39 and therefore may also be used to control the time delay.

Figure 13:
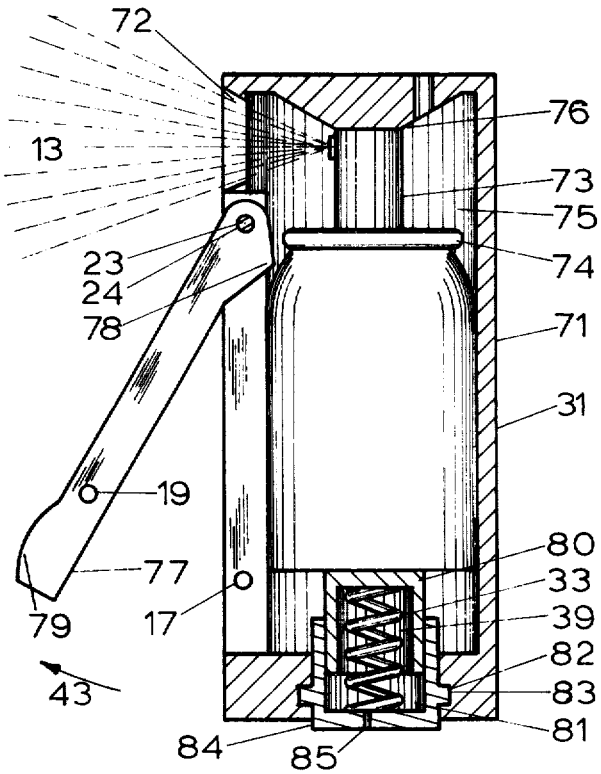
FIG. 13 is a horizontal section taken along line D—D of FIG. 11 but showing the spring biased element in its released position after the device has been triggered.
Figure 11:
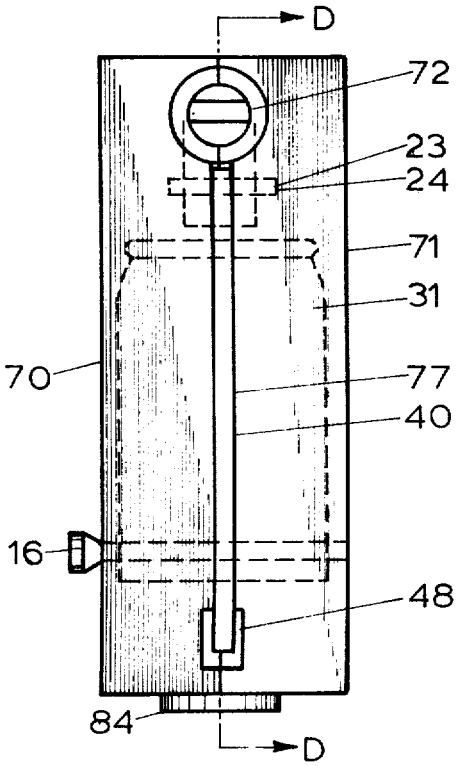
FIG. 11 is a front elevational view similar to FIG. 3 but showing a fifth embodiment of the fluid dispensing anti-burglary device containing a pressurized container of the aerosol type with a projecting dispensing cap.
Figure 12:
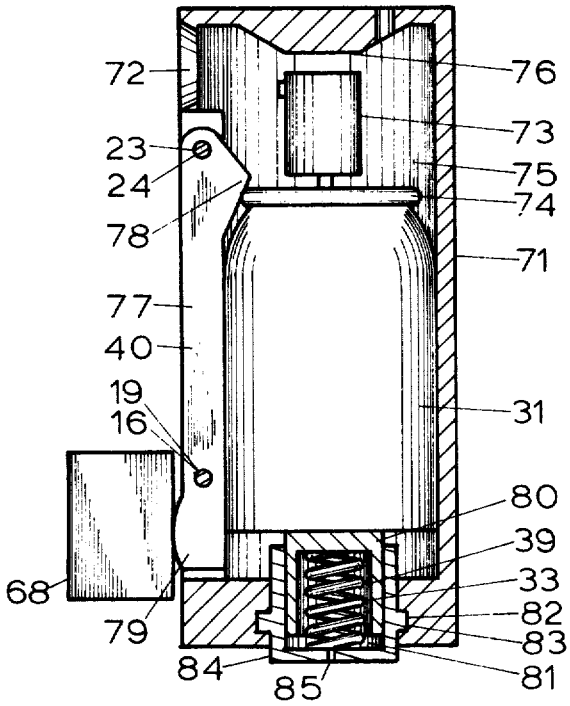
FIG. 12 is a vertical section taken along line D—D of FIG. 11 showing the spring biased element in a cocked position.

A fifth embodiment of the invention is illustrated in FIGS. 11, 12 and 13. In this embodiment, the structure is as previously described in the first embodiment and like numbers are used to indicate like or corresponding parts.

In this embodiment, the projecting dispensing spout 35 of pressurized fluid container 31, shown in FIG. 4, is replaced with a projecting dispensing cap 73 shown in FIGS. 11, 12 and 13. In addition, the fluid passageway 41 and the entry section 36 are replaced with an aperture 72.

Now referring to FIG. 12 and FIG. 13, the trigger 77, the spring 33 and time delay operate as before to move the pressurized container 31. In this embodiment, the spring 33 urged pressurized container 31 causes the projecting cap 73 to be depressed against the inside top portion 76 of body halves 70 and 71; thereby causing discharge through aperture 72.

It is important in this embodiment that the fluid-dispensing element comprise of a projecting dispensing cap 73 which when depressed causes fluid discharge therethrough. The body member 11 contains an aperture 72 in communication with the projection dispensing cap 73 to provide for fluid discharge from the body member 11. A dispensing element-actuating means is provided by the surface 76 which will depress the dispensing cap 73 when the container 31 is moved toward it and thereby cause fluid discharge.

In the anti-burglar device 6 previously described, the trigger 7 is released when cord 5 is pulled. The trigger 7 holds the pressurized container in a cocked position. In this embodiment, the trigger 7 is replaced by a self-camming trigger 77 as best seen in FIGS. 12 and 13 wherein the self-camming trigger 77 will be forced to rotate in the direction of arrow 43 by the action of the flange 74 of the pressurized container 31 of the spring 33 urged pressurized container 31. The operation of this self-camming trigger element 77 will become apparent in the following description.

The retaining means acting on the self-camming trigger 77 is a movable object 68. Any movable object such as a window, door, TV set, Hi Fi set etc. can be mounted to retain the trigger 77. If it is desired to move the protected object, the safety pin 16, previously described is inserted in a manner to engage hole 19 in trigger 77 thus safely deactivating the device. However, if properly installed, the intruder will not notice the device and move the protected object and cause discharge.

Figure 16:
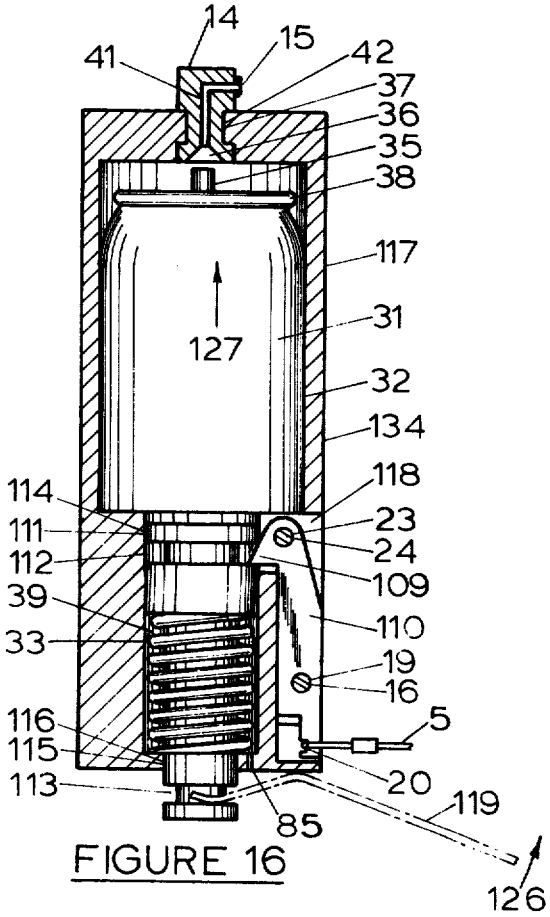
FIG. 16 is a vertical sectional similar to FIG. 4 but showing a sixth embodiment containing a trigger working on a spring biased element which causes movement of the pressurized container.

A sixth embodiment of the invention is illustrated in FIG. 16. In this embodiment, the basic structure is as previously described in the first embodiment and like numbers are used to indicate like or corresponding parts. The fluid dispensing anti-burglary device of this embodiment is generally noted device 117.

In this embodiment, the trigger 7 of the first embodiment is replaced with a trigger 110 which is made to work on a time delay element generally called a biased actuating member 111. The trigger 110 is connected to a cord 5 and operates in the manner previously described.

The time delay assembly 84 of the first embodiment is modified to provide a means for the trigger 110 to retain a biased actuating member 111 in a cocked position. The biased actuating member 111, one type of which is shown as having two cylindrical portions 114 and 115. The body member 134 contains coaxial bores 112 and 116 to slidably mount the biased actuating member 111. A spring 33 is mounted in its spring cavity 39 and urges the biased actuating member 111 in the direction of 127.

Figure 14:
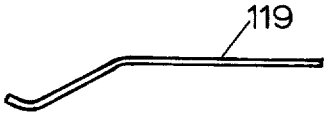
FIG. 14 is a side elevational view of a lever for resetting the anti-burglar device if accidentally triggered.
Figure 15:
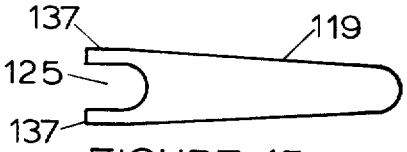
FIG. 15 is a top view of FIG. 14.

The biased actuating member 111 contains a notch 113 for engaging with a resetting tool 119 which is used to recock the biased actuating member 111 and reset the trigger 110, if the device is accidentally released. The resetting tool 119 is shown in FIGS. 14 and 15 as having a notched portion 125 whereby two extensions 137 remain for engaging in notch 113 of the biased actuating member 111. By inserting the resetting tool 119 into the notch 113 as best seen in FIG. 16 and moving the resetting tool 119 in the direction of 126, the device 117 may be reset.

When cord 5 is pulled, the trigger 110 rotates around shaft 23 and slides its catch 109 from engagement with the biased actuating member 111. The spring 33 urges the biased actuating member 111 in the direction of 127 but the vacuum formed in cavity 39 impedes its movement. A small hole 85 in body member 134 provides a small flow of air which will permit the spring 33 to slowly move the biased actuating member 111 and the pressurized container 31 in the direction 127. The device 117 will then discharge as previously described.

Figure 18:
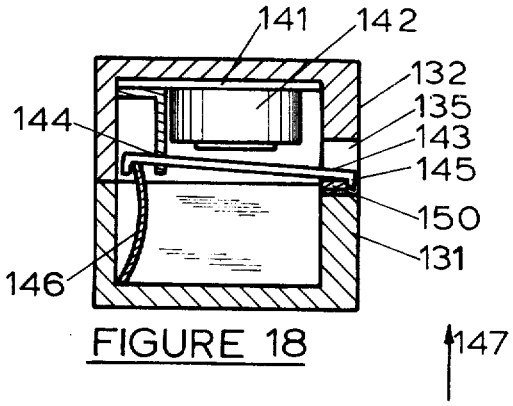
FIG. 18 is a horizontal section taken along line E—E of FIG. 17 showing the electromechanical actuator in its actuation position.
Figure 17:
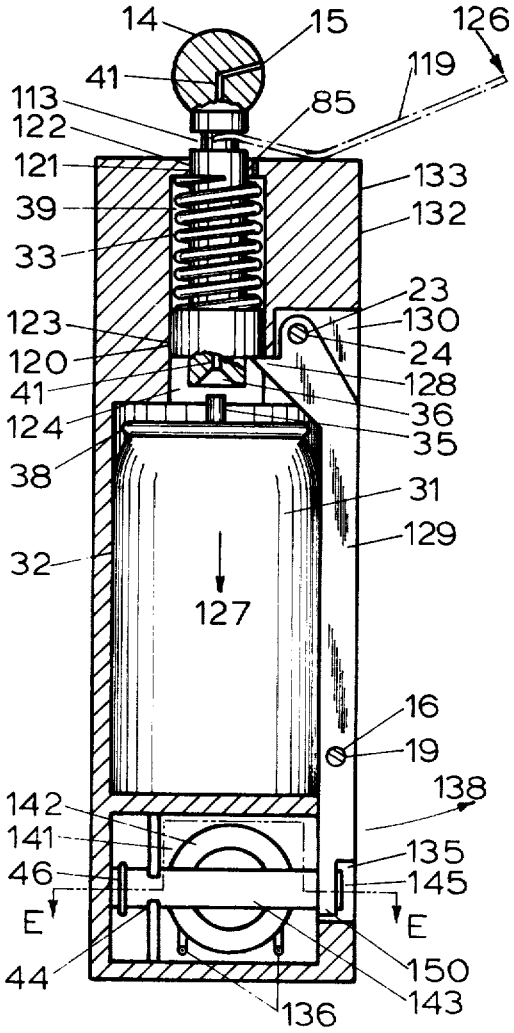
FIG. 17 is a vertical section similar to FIG. 4 but showing a seventh embodiment containing an electromechanical actuator holding the trigger in its actuation position and a spring biased element for direct application of force on the dispensing element of the pressurized container.

A seventh embodiment of the invention is illustrated in FIGS. 17 and 18. In this embodiment, the basic structure is as previously described in the sixth embodiment and like numbers are used to indicate like or corresponding parts. The fluid dispensing anti-burglary device of this embodiment is generally noted device 133.

In the anti-burglar device 134 previously described, the trigger 110 is released when cord 5 is pulled. The trigger 110 holds the biased actuating member 111 in a cocked position. In this embodiment, the trigger 110 is replaced by trigger 129 as best seen in FIGS. 17 and 18. The trigger 129 is pivotably mounted on shaft 23 with its latch element 128 releasably retaining a biased actuating member 120. The spring 33 urged biased actuating member 120 will cause the trigger 129 to rotate in the direction of 138. The trigger 129 will be prevented from rotation by the latch lever 143 engaging with trigger extension 150.

The biased actuating member 120, one type of which is shown as having two cylindrical portions 122 and 123. The body member 132 contains coaxial bores 121 and 124 to slidably mount the biased actuating member 120. A spring 33 is mounted in the spring cavity 39 and urges the biased actuating member 120 in the direction 127.

The biased actuating member 120 contains a notch 113 for engaging with a resetting tool 119 which is used to reset the device 133 in a manner described in the sixth embodiment.

An electromechanical device generally noted 141 is used to releasably retain the trigger 129. The electromechanical actuator 141 comprises an electromagnetic coil 142, a solenoid latch lever 143, a lever pivot point 144 and a latch lever spring 146. The components of the electromechanical actuator 141 are arranged in a manner that when power is applied to the electromagnetic coil 142, a magnetic flux is generated, causing the latch lever 143 to be attracted toward the coil 142 and to rotate around pivot point 144. The rotation of the latch lever 143 will be confined from further movement by the electromagnetic coil 142. The latch lever 143 is held in a normal rest position by the action of spring 146 exerting force on the latch lever 143 in direction opposite of arrow 147. This causes the catch 145 of latch lever 143 to move in the same direction and causes the latch lever 143 to rest against the trigger 129 and prevent the trigger 129 from rotating in the direction 138.

When electric power is applied to the electromagnetic coil 142, thus, energizing the electromagnetic coil 142; the solenoid latch lever 143 is pulled toward the electromagnetic coil 142 in direction 147 around pivot point 144 thereby moving the latch lever catch 145 away from engagement with the trigger 129 at notch 150; whereupon the spring 33 urged biased actuating member 120 engaging with the latch portion 128 of the trigger 129 causes the trigger 129 to rotate in the direction of arrow 138. This permits the spring 33 urged biased actuating member 120 to be moved in the direction of arrow 127 until the projecting dispensing spout 35 of the pressurized container 31 is in seated engagement with the entry section 36; further movement of the biased actuating member 120 will depress the projecting dispensing spout 35 and cause the fluid 13 to be released from the pressurized container 31; through the dispensing spout 35, the entry section 36, the fluid passageway 41 and the orifice 15 in dispensing head 14.

The movement of the biased actuating member 120 is again controlled by controlling the air flow through hole 85 as described in the first embodiment.

Figure 22:
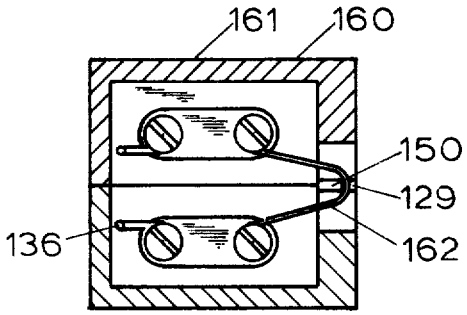
FIG. 22 is a horizontal section taken along line F—F of FIG. 21 showing the fusible link holding the trigger element in its actuation position.
Figure 21:
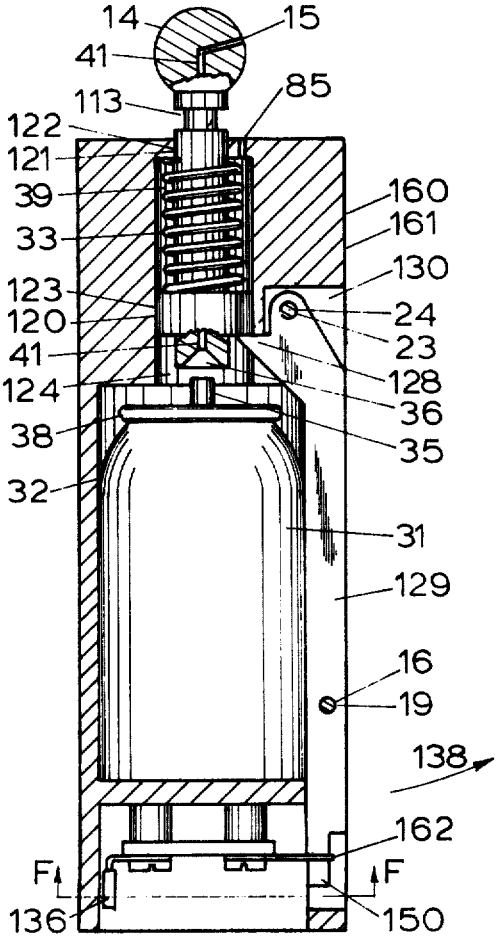
FIG. 21 is a vertical section similar to FIG. 4 but showing an eighth embodiment of the anti-burglary device containing a fusible link holding the trigger in its actuation position.

An eighth embodiment of the invention is illustrated in FIGS. 21 and 22. In this embodiment the structure is as previously described in the seventh embodiment and like numbers are used to indicate like or corresponding parts.

In this embodiment, the releasably retaining means acting on the trigger 129, is a fusible link 162 which replaces the electromechanical actuator 141 of the seventh embodiment. The fusible link 162 will safely retain the trigger 129 from rotation until an electric current is passed through the fusible link 162 in a manner previously described in the seventh embodiment, causing fusible link 162 to melt and release the trigger 162 which causes discharge.

Figure 25:
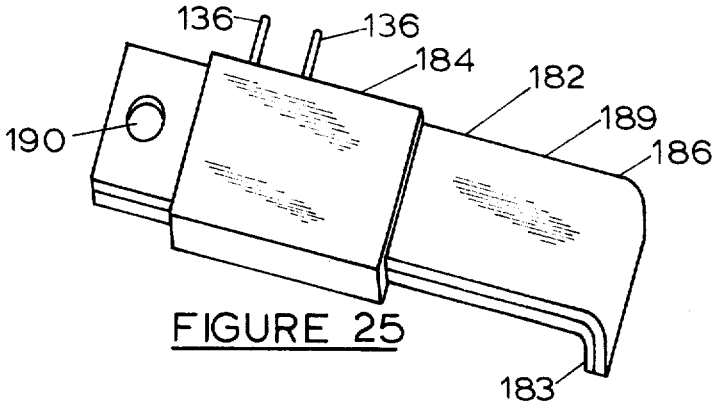
FIG. 25 is an elevational view of the electrothermal trigger.
Figure 23:
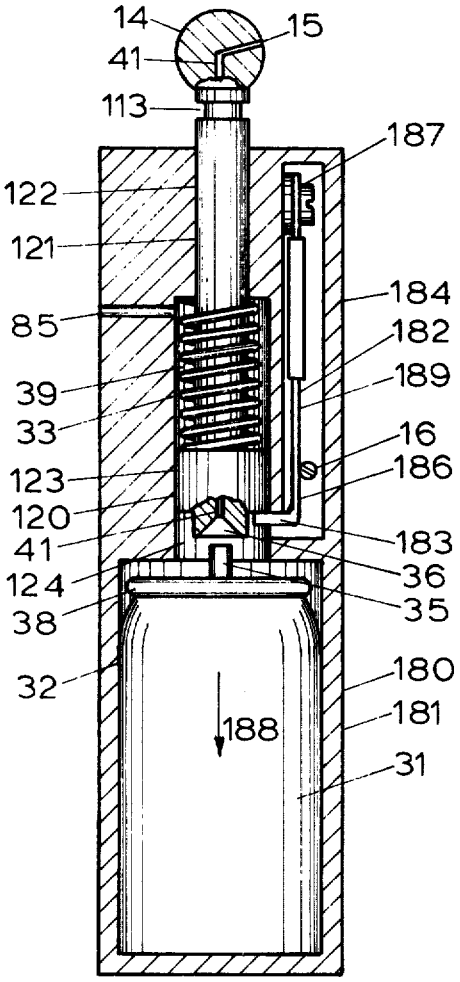
FIG. 23 is a vertical section similar to FIG. 4 but showing a ninth embodiment of the anti-burglary device containing an electrothermal trigger.
Figure 24:
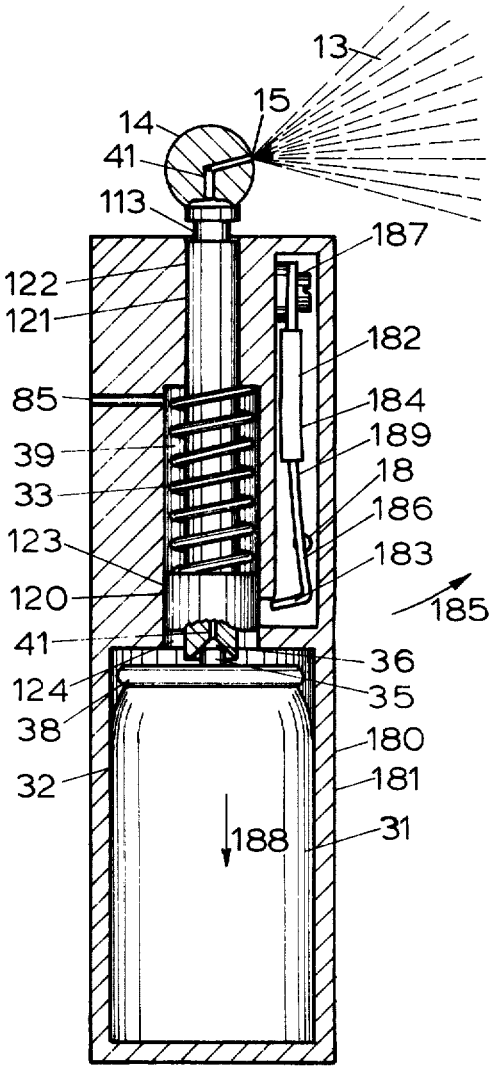
FIG. 24 is a vertical section similar to FIG. 23 but showing the electrothermal trigger after the heat was applied and the device discharging.

A ninth embodiment of the invention is illustrated in FIGS. 23 to 25. In this embodiment, the structure is as previously described in the seventh embodiment and like numbers are used to indicate like or corresponding parts.

In this embodiment the trigger 129 is replaced by an electrothermal trigger generally designated 182. The electrothermal trigger 182 is best shown in FIG. 25 as being comprised of bimetal strip 189 made of two different materials and having two different coefficients of thermal expansion. Applied heat will cause the bimetal strip 189 to bend because of the different thermal expansion properties of the dissimilar materials used. A latch portion 183 is formed on the trigger extension 186 of the electrothermal trigger 182 and hole 190 for mounting in the housing 181 is formed on the other end. A heating coil 184 is attached to the bimetal strip 189 to provide heat when electric current is passed through the heating coil 184.

The electrothermal trigger 182 is mounted in the body member 181 as best seen in FIGS. 23 and 24. The latch portion 183 of the electrothermal trigger 182 engages with the biased actuating member 120 to retain the actuating member 120 in its cocked position.

A safety pin 16 may be inserted in the body member 181 to prevent the release of the biased actuation member 120 if the device 180 is accidentally triggered.

As electric current is applied to the heating coil 184, bending caused by the expansion of the dissimilar materials will cause the electrothermal trigger 182 to move in the direction of 185, thereby releasing the biased actuating member 120 to cause fluid discharge as previously described in the seventh embodiment.

Figure 27:
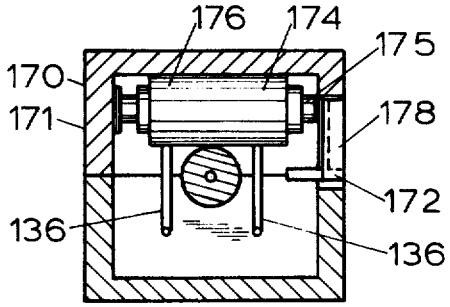
FIG. 27 is a horizontal section taken along line G—G of FIG. 26 showing the electromechanical actuator for releasing the trigger.
Figure 26:
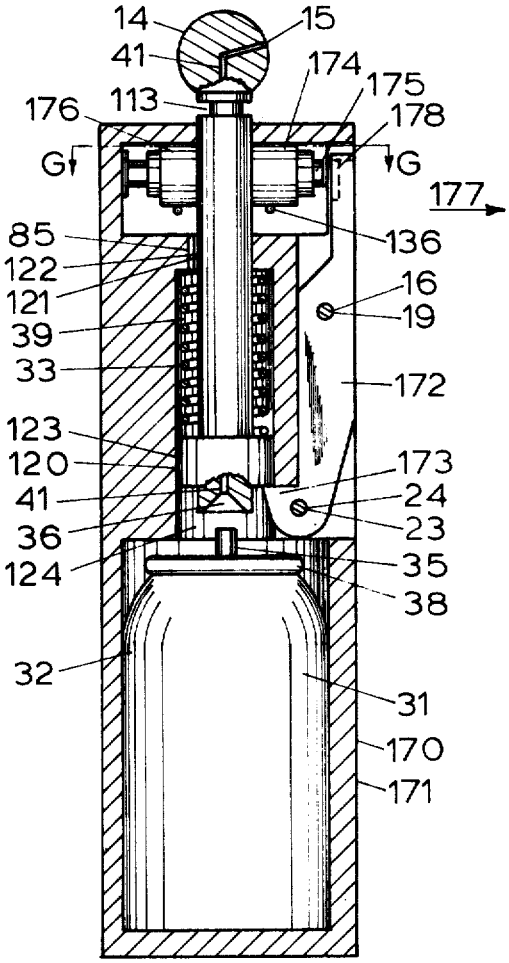
FIG. 26 is a vertical sectional similar to FIG. 4 but showing the anti-burglar device containing an electromechanical actuator for releasing the trigger.

A tenth embodiment of the invention is illustrated in FIGS. 26 and 27. In this embodiment, the structure is as previously described in the seventh embodiment and like numbers are used to indicate like or corresponding parts.

In this embodiment, the trigger 129 is replaced by a trigger 172 wherein the extension 150 of trigger 129 is replaced with an extension 178. In addition, the device 170 is equipped with an electromechanical actuator 174 of the solenoid push type wherein the solenoid plunger 175 is mounted to engage the extension 178 of trigger 172.

The device 170 is installed and operates in the manner described in the seventh embodiment. As the solenoid coil 176 is energized and the plunger 175 moves in the direction 177, pushing on extension 178 of trigger 172. This releases the biased actuating member 120, previously described and discharges the device.

The chemical dispensing anti-burglary device described herein in several embodiments was generally shown with a pressurized container 31 with a projecting dispensing spout 35 mounted to discharge into a funnel shaped entry section 36 of a fluid passageway 41 when the device is discharged. Alternately the device will also function with a pressurized container of the aerosol type with a recessed value by providing a tubular member depending from the body member to cause discharge; in addition the devices can be used with a sealed pressurized container with a pierceable seal; also the aerosol type container with a dispensing projecting cap wherein the projecting cap is depressed to cause discharge; but the invention is not limited to these type of containers.

Although I have herein shown and described the invention in what I have conceived to be the most practical and preferred embodiments, it is recognized that departure may be made therefrom within the scope of my invention, which is not to be limited to the details disclosed herein, but is to be accorded the full scope of the claims so as to embrace any and all equivalent structures and devices.

I claim:

1. A fluid dispensing anti-burglar device for use with a pressurized container, the device comprising:

a. a body member;

b. means for supporting said pressurized container in said body member, wherein said pressurized container has a fluid-dispensing element adapted to release fluid under pressure from said pressurized container when actuated;

c. a passageway in said body member having an entry section at one end thereof;

d. dispensing element-actuating means mounted in said body member and adapted to engage and actuate said fluid-dispensing element;

e. spring means biased to force said fluid-dispensing element and said dispensing element-actuating means into engagement with each other, thereby causing said fluid-dispensing element to be actuated;

f. trigger means adapted to releasably retain said spring means in a cocked position in which said fluid-dispensing element and said dispensing element-actuating means are separated from each other;

g. trigger-actuating means associated with said trigger to actuate said trigger upon the application of force to said trigger-actuating means, whereby said spring is released from its cocked position causing said fluid-dispensing element to be actuated, and fluid under pressure is released from said container to pass through said passageway;

h. and delay means for causing the delay of the engagement of said fluid-dispensing element with said dispensing element-actuating means after said trigger releases said spring means, thereby permitting the resetting of the device if the trigger is accidentally released.

2. The fluid dispensing anti-burglar device of claim 1 in which said fluid-dispensing element of the pressurized container comprises a pierceable section, means to provide a seal between said pierceable section and said entry section, and means for puncturing said pierceable section, whereby fluid may be discharged.

3. The fluid dispensing anti-burglar device of claim 2 in which said means for puncturing comprises a projecting spout depending from said body member.

4. The fluid dispensing anti-burglar device of claim 1 wherein said trigger is mounted for rotation between an actuation position and a release position, said trigger when in said actuation position retaining said spring means in said cocked position, and said trigger when in said release position allowing said spring means to actuate said fluid-dispensing element, thereby causing fluid discharge.

5. The fluid dispensing anti-burglar device of claim 1 wherein said trigger is mounted for sliding movement between an actuation position and a release position, said trigger when in said actuation position retaining said spring means in said cocked position, and said trigger when in said release position allowing said spring means to actuate said fluid-dispensing element, thereby causing fluid discharge.

6. The fluid dispensing anti-burglar device of claim 1 wherein said trigger is in shouldered engagement with said spring means to retain said spring means in a cocked position.

7. The fluid dispensing anti-burglar device of claim 1 wherein said trigger is in cammed engagement with a shaped surface of said spring means to retain said spring means in an actuation position, said shaped surface of said spring means arranged to move said trigger from said actuation position to a release position, means for holding said trigger in said actuation position wherein said trigger is in engagement with said spring means, said holding means mounted for movement between a holding position and a release position, said holding means in said holding position securing said trigger in engagement with said shaped surface of said spring means, said holding means in said release position permitting said trigger to move to its release position.

8. The fluid dispensing anti-burglar device of claim 1 wherein said fluid-dispensing element of said pressurized container includes a dispensing valve actuated to permit fluid discharge therethrough upon depression thereof, said valve being actuated to said release position through movement caused by the release of said spring means whereby the valve is depressed and fluid is discharged.

9. The fluid dispensing anti-burglar device of claim 8 wherein said valved pressurized container contains a projecting dispensing spout, said dispensing spout discharging fluid upon depression thereof, said entry section of said passageway being funnel shaped for receiving said projecting dispensing spout on said container.

10. The fluid dispensing anti-burglar device of claim 8 wherein said valved pressurized container includes a recessed valve, said body member includes a projection in said entry section extending beyond said entry section toward said container to engage said recessed valve, said recessed valve actuated upon depression thereof to emit fluid.

11. The fluid dispensing anti-burglar device of claim 8 wherein said valved pressurized container contains a projecting dispensing cap actuated to permit fluid discharge therethrough upon depression thereof, an aperture in said body member in communication with said cap, said spring means arranged to actuate said dispensing cap upon release thereby discharging said pressurized container through said cap and aperture when said spring means is released.

12. The fluid dispensing anti-burglar device of claim 1 wherein said trigger-actuating means associated with said trigger comprises a means for moving said trigger from an actuation position to a release position, said trigger moving means including a means for attaching a cord to said trigger, said cord arranged to cause movement of said trigger.

13. The fluid dispensing anti-burglar device of claim 1 wherein said trigger-actuating means associated with said trigger comprises a means for electromechanically retaining and releasing said trigger.

14. The fluid dispensing anti-burglar device of claim 13 wherein said electromechanical retaining-releasing means of said trigger comprises a solenoid latch lever for retaining said trigger in an actuation position whereby said spring means is held in a cocked position, said solenoid lever being resiliently held in engagement with said trigger to retain said spring means in said cocked position, and a magnetic cored coil for moving said solenoid lever out of engagement with said trigger whereby said trigger moves to said release position.

15. The anti-burglar fluid dispensing device of claim 1 wherein said trigger-actuating means associated with said trigger comprises a solenoid containing an electromagnetic coil and a plunger, said electromagnetic coil and plunger being mounted to cause release of said trigger when said electromagnetic coil is electrically energized.

16. The fluid dispensing anti-burglar device of claim 1 wherein there is means for retaining said trigger in an actuation position whereby said spring means is held in a cocked position, said retaining means comprising of a fusible link mounted in engagement with said trigger to retain said trigger in said actuation position, said fusible link to release said trigger when an electric current is passed through said fusible link.

17. The fluid dispensing anti-burglar device of claim 1 wherein the trigger comprises of an electrothermal trigger, said electrothermal trigger comprising of a bi-metal trip which deflects upon application of heat, an electric resistance heater arranged to heat said bi-metal strip, said electrothermal trigger arranged to hold said spring means in a cocked position, and said electrothermal trigger to release said spring means when heat is applied said electrothermal trigger when an electric current is passed through said electric resistance heater thereby causing fluid discharge.

18. The fluid dispensing anti-burglar device of claim 1 wherein the delay means comprises a cylindrical bore and a piston, said cylindrical bore positioned in said body member whereby said piston is slidably mounted in said cylindrical bore and arranged to retard the movement of said spring means when said trigger moves to its release position.

19. The fluid dispensing anti-burlar device of claim 1 and a resetting means whereby the spring means may be recocked and the trigger reset after the trigger moves to its release position but before the time delay permits fluid discharge.

20. The fluid dispensing anti-burglar device of claim 1 wherein the spring means comprises a spring biased actuating member arranged to actuate said fluid-dispensing element after a time delay.

21. The fluid dispensing anti-burglar device of claim 1 wherein said pressurized container is slidably supported in said body member and spring biased toward said dispensing element-actuating means, said trigger in an actuation position is arranged to engage and hold said pressurized container in a cocked position whereby the fluid-dispensing element of said pressurized container is displaced from said dispensing element-actuating means, said trigger in a release position permitting said fluid-dispensing element of said spring biased pressurized container to be moved into engagement with the dispensing element-actuating means to cause fluid discharge after a time delay.

22. The fluid dispensing anti-burglar device of claim 1 wherein said pressurized container is slidably supported in said body member, the spring means comprising a spring biased actuating member slidably supported in said body member and arranged to move said slidably supported pressurized container toward said dispensing element-actuating means, said trigger in an actuation position arranged to engage and hold said biased actuating member in a cocked position whereby said pressurized container is displaced from the biased actuating member, said trigger element in a release position permitting said spring biased actuating member to move said fluid-dispensing element of said pressurized container into engagement with said dispensing element-actuating means, thereby causing fluid discharge after a time delay.

23. The fluid dispensing anti-burglar device of claim 1 wherein said spring means comprises a spring biased actuating member containing said dispensing element-actuating means and arranged for movement in said body member, said trigger in an actuation position arranged to engage and hold said spring biased actuating member in a cocked position whereby said dispensing element-actuating means is displaced from said fluid-dispensing element, said trigger in a release position permitting said spring biased actuation member to be moved toward said pressurized container such that said dispensing element-actuating means engages with said fluid-dispensing element, thereby causing fluid discharge after a time delay.

* * * * *